United States Patent [19]

Zampini, Jr.

[11] Patent Number: 4,467,628

[45] Date of Patent: Aug. 28, 1984

[54] COMBINATION LOCK

[75] Inventor: Louis Zampini, Jr., North Providence, R.I.

[73] Assignee: American Tourister, Inc., R.I.

[21] Appl. No.: 372,232

[22] Filed: Apr. 28, 1982

[51] Int. Cl.[3] ..... E05B 37/02

[52] U.S. Cl. ..... 70/312; 70/316

[58] Field of Search ..... 70/312, 314–316, 70/304

[56] References Cited

U.S. PATENT DOCUMENTS

| | | | |
|---|---|---|---|
| 2,136,493 | 12/1936 | Denerich . | |
| 3,555,860 | 1/1971 | Atkinson | 70/312 |
| 4,308,731 | 1/1982 | Remington . | |
| 4,356,712 | 11/1982 | Bako | 70/312 X |
| 4,389,863 | 6/1983 | Bako | 70/312 |

*Primary Examiner*—Thomas J. Holko
*Assistant Examiner*—Thomas J. Dubnicka
*Attorney, Agent, or Firm*—Burns, Doane, Swecker & Mathis

[57] ABSTRACT

A permutation lock is mounted on one of a pair of hinged sections and is adapted to receive and lock to a hasp of the other section. The lock includes a plurality of rotatable dials which act against a movable bolt to move a latching end of the latter toward and away from a locking position. Even with the dials in a locked mode, the bolt can be moved to an unlocking position in response to introduction of the hasp into the lock. The hasp includes a completely closed aperture which is adapted to receive a pair of hooks at the latching end of the bolt.

15 Claims, 7 Drawing Figures

Fig. 6
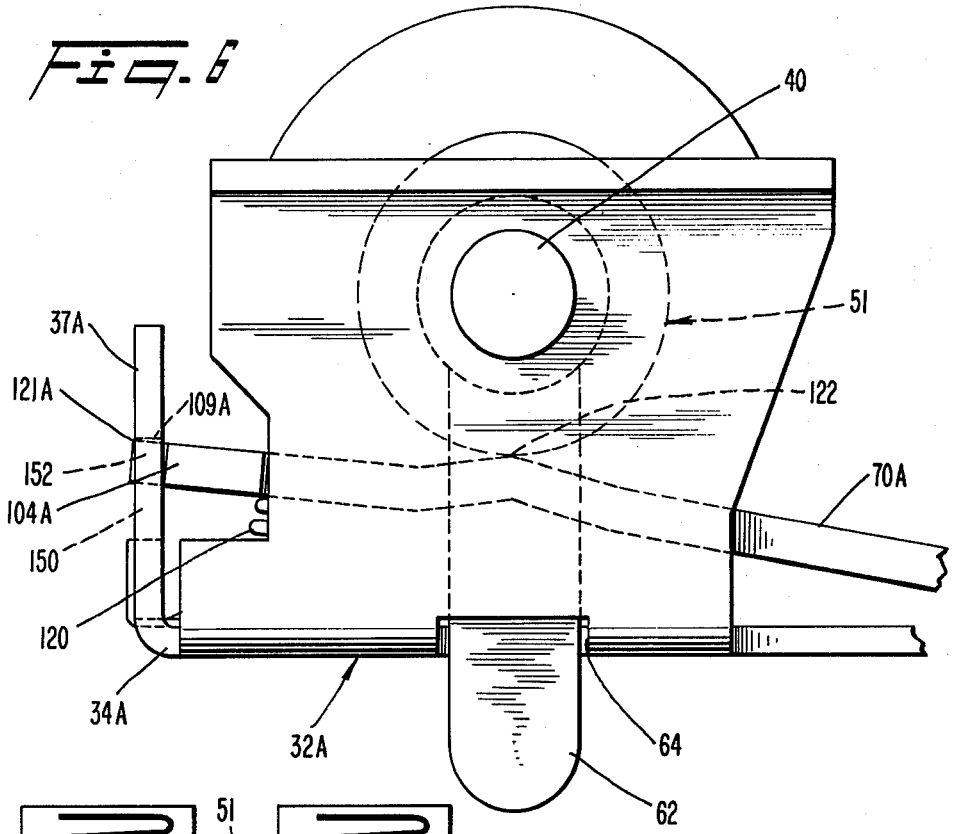
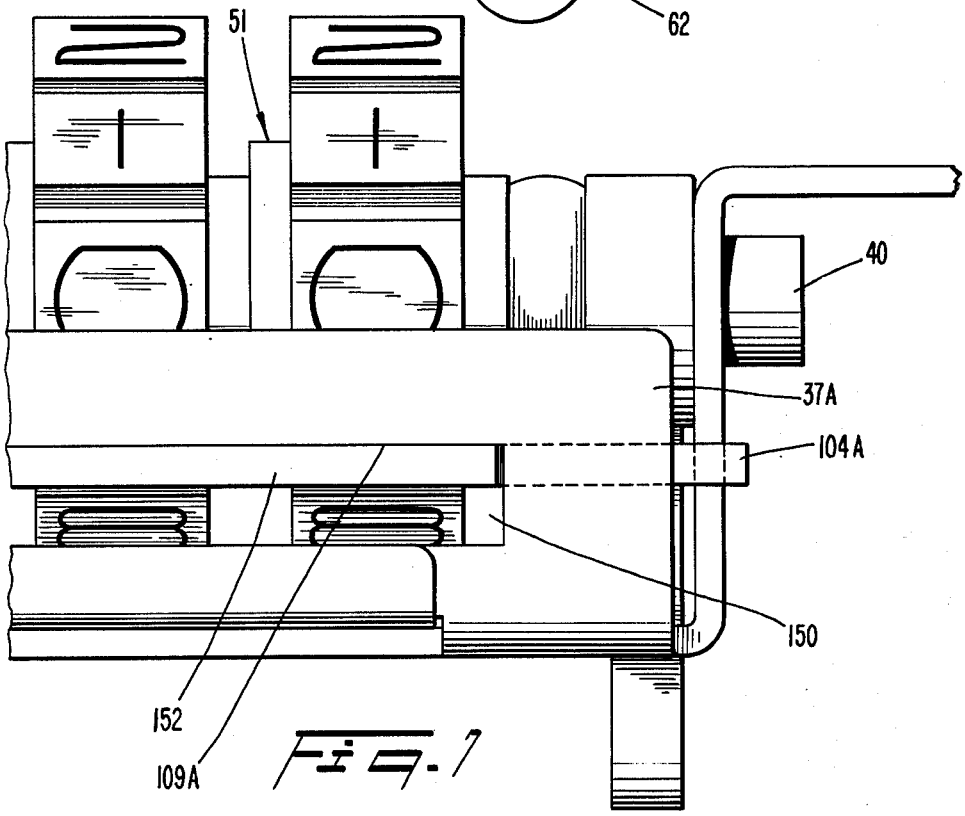
Fig. 7

COMBINATION LOCK

BACKGROUND AND OBJECTS OF THE INVENTION

The present invention relates to locks and, in particular, to combination locks of the type which are installed on luggage, briefcases, metal lock boxes, etc.

Combination or permutation locks are typically employed in luggage and briefcases to secure together a pair of hinged sections, as is evident for example from the disclosures of Remington U.S. Pat. No. 4,308,731 issued Jan. 5, 1982 and Denerich U.S. Pat. No. 2,136,493 issued Nov. 15, 1938. In the Remington patent there is disclosed a lock wherein a lock unit on one of the hinged sections is arranged to lock and unlock a hasp on the other hinged section. The lock unit includes a slotted bolt which has a pair of mounting lugs seated in a pair of notches of a stationary frame. The notches define a fulcrum for the bolt, enabling a front latching end thereof to travel between latching and unlatching positions relative to the hasp. A series of rotary dials are disposed adjacent the bolt and project through slots in the bolt. The bolt is configured to engage cams which are drivingly connected to respective ones of the dials. Each cam is generally circular with an indented segment that can be flat or V-shaped. The bolt is in its unlocked position when the cams are arranged to engage the bolt with their indented segments, the bolt being spring-biased toward the cams. When any of the cams is displaced such that the circular periphery thereof engages the bolt, the bolt is swung about its rear anchoring end such that the front latching end is moved to a latching position against the spring bias. When the indented segment of the displaced cam(s) is returned to engagement with the bolt, the bolt again swings about its rear anchoring end under the spring bias such that the latching end moves to its unlocking position. One characteristic of such an arrangement is that when the latch is in a latching position, the hasp cannot be inserted into the latching assembly. That is, the latching end of the bolt unyieldably blocks the entrance to the latching mechanism.

In the afore-mentioned Denerich patent, a combination lock is disclosed wherein a lock unit receives and locks to a hasp even when in its locking mode. This is achieved by providing the latching end of the bolt with a cam face such that when the latch is closed and is engaged by the hasp, a force is imposed on the latch tending to swing the bolt to an auxiliary unlocking position in a direction opposite the normal unlocking direction of the bolt. The notches which receive the rear lugs are flared at their rear ends to accommodate a sufficient amount of pivotal movement of the lugs to enable the latch to be depressed to the auxiliary unlocking position by the hasp. After the hasp has passed over the latch, the bolt is returned to its locking position by a spring force. In such an arrangement, the notches define the sole fulcrum for movement of the bolt, similar to the afore-mentioned Remington patent. Since the extent of swinging movement of the bolt is greater in the Denerich patent due to the ability of the hasp to cam the latch in a direction opposite the usual unlocking direction, the height of the lock unit must be made large enough to accommodate such movement. Furthermore, since the bolt can be moved to an unlocking mode in a direction away from the dial axis and thus away from the exposed face plate through which the dials project, special care must be taken to ensure the security of the lock. That is, the design must be such that a slender tool cannot be inserted through the slots of the face plate (i.e., inserted between the dial and the face plate) sufficiently far to contact and push the bolt toward the auxiliary unlocking mode. It will further be appreciated that the design of the latch and hasp may be somewhat limited in the Denerich lock since such design must permit latching to occur when the latch approaches the hasp from two directions, i.e., toward and away from the dial axis.

It is, therefore, an object of the present invention to minimize or obviate shortcomings of the type previously discussed.

Another object of the invention is to provide an improved permutation lock.

A further object is to provide an improved permutation lock of the type incorporated within containers such as luggage, briefcases, metal boxes, etc., which enables a hasp to be locked even when the locking bolt is in a locking mode.

An additional object is to provide such a lock which is highly resistant to being "picked".

A further object is to provide such a lock which employs a closed hasp that presents a minimal risk of catching on clothing.

SUMMARY OF THE INVENTION

These objects and advantages are achieved in accordance with the present invention which relates to a permutation lock of the type which is to receive and lock to a hasp. The lock comprises a frame which includes a stop shoulder. A shaft is mounted to the frame and defines a longitudinal axis. A plurality of manually actuable rotary members are mounted on the shaft for rotary movement about the longitudinal axis. Each rotary member includes an annular actuating surface having a camming segment and an indented segment, and an annular indicator surface carrying indicia and being in driving engagement with the actuating surface. A bolt is spaced from the shaft and includes slots through which the indicator surfaces project such that the actuating surfaces are engageable with the bolt. The bolt includes front and rear ends. The front end has a deflecting surface and a latch disposable in a locking position when the bolt is engaged by one of the camming segments, and in an unlocking position when the bolt is opposed by all of the indented segments. A spring biases the bolt toward the actuating surfaces of the rotary members so that the rear end of the bolt is biased against the stop shoulder of the frame. The spring is yieldable to enable the camming segments to swing the bolt about a first fulcrum at the stop shoulder to move the latch from the unlocking position to the locking position. The rear end of the bolt is unsupported opposite the stop shoulder so as to be movable in a direction away from the stop shoulder in response to swinging of the bolt about a second fulcrum defined by at least one of the caming segments. This enables the latch to be moved to the unlocking position from the locking position when so urged by the hasp acting against the deflecting surface.

Preferably, the latch end of the bolt includes a pair of hooks which are adapted to enter a completely enclosed aperture of the hasp.

BRIEF DESCRIPTION OF THE DRAWINGS

These objects and advantages of the invention will become apparent from the following detailed description of a preferred embodiment thereof, in connection with the accompanying drawings in which like numerals designate like elements, and in which:

FIG. 6 is a side elevational view of a modified form of lock according to the present invention, with the bolt disposed in a locked condition; and FIG. 7 is a rear view of a portion of the lock depicted in FIG. 6.

DETAILED DESCRIPTION OF A PREFERRED EMBODIMENT OF THE INVENTION

Figure 1:
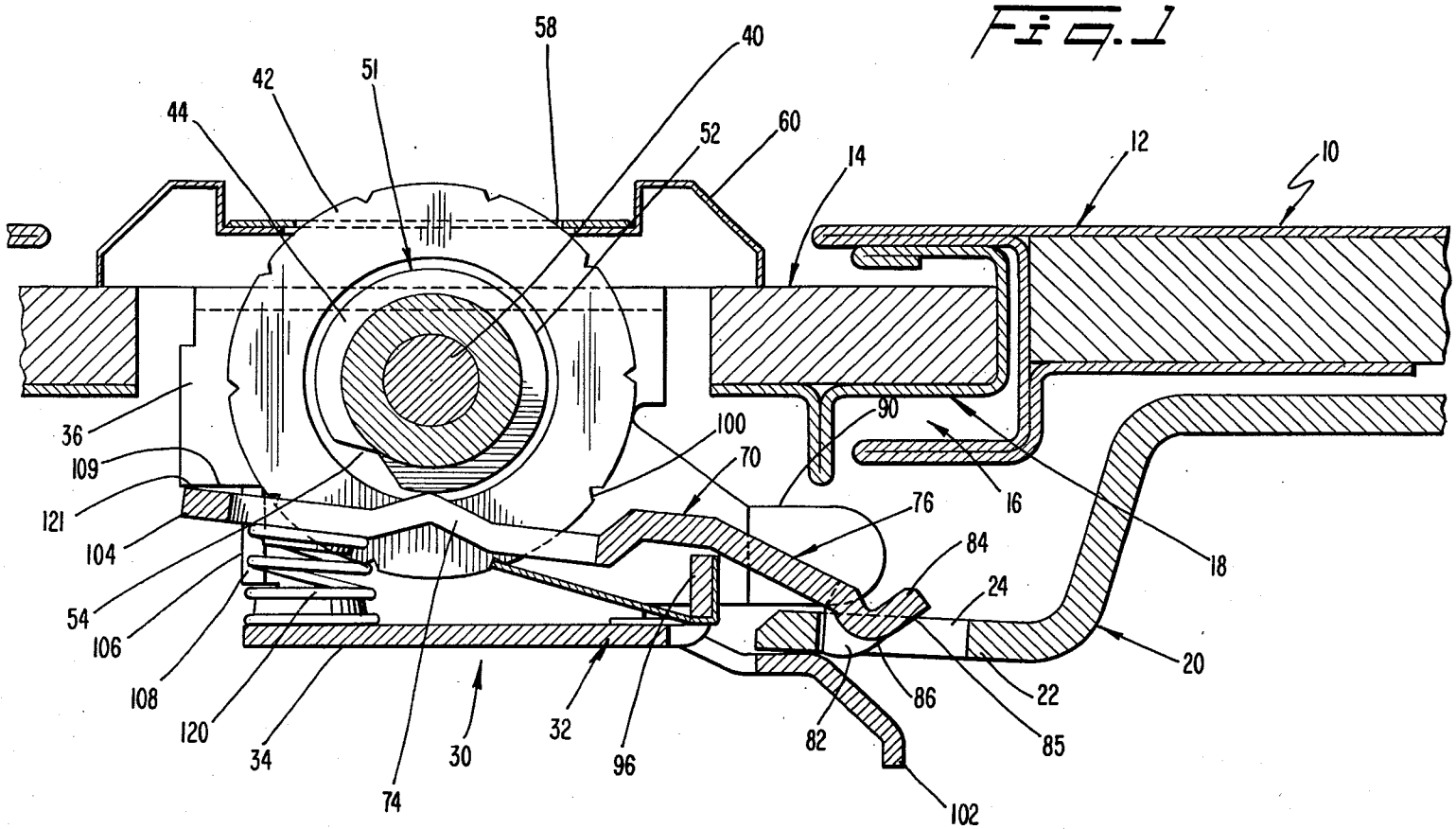
FIG. 1 is a cross-sectional view taken through a portion of a pair of hinged sections and a permutation lock mounted in one of the sections, wherein a hasp on one of the sections is lockingly coupled to a bolt of the permutation lock.

In FIG. 1, there is depicted a section of a container 10 of the type which has a pair of hinged sections 12, 14, such as the box and lid of a briefcase, for example. The box 12 includes a metal frame which forms a channel 16 sized to receive a lip 18 of the lid.

Fastened to the box frame is a metal hasp 20. The hasp 20 includes a locking portion 22 which has an elongated aperture 24.

Figure 3:
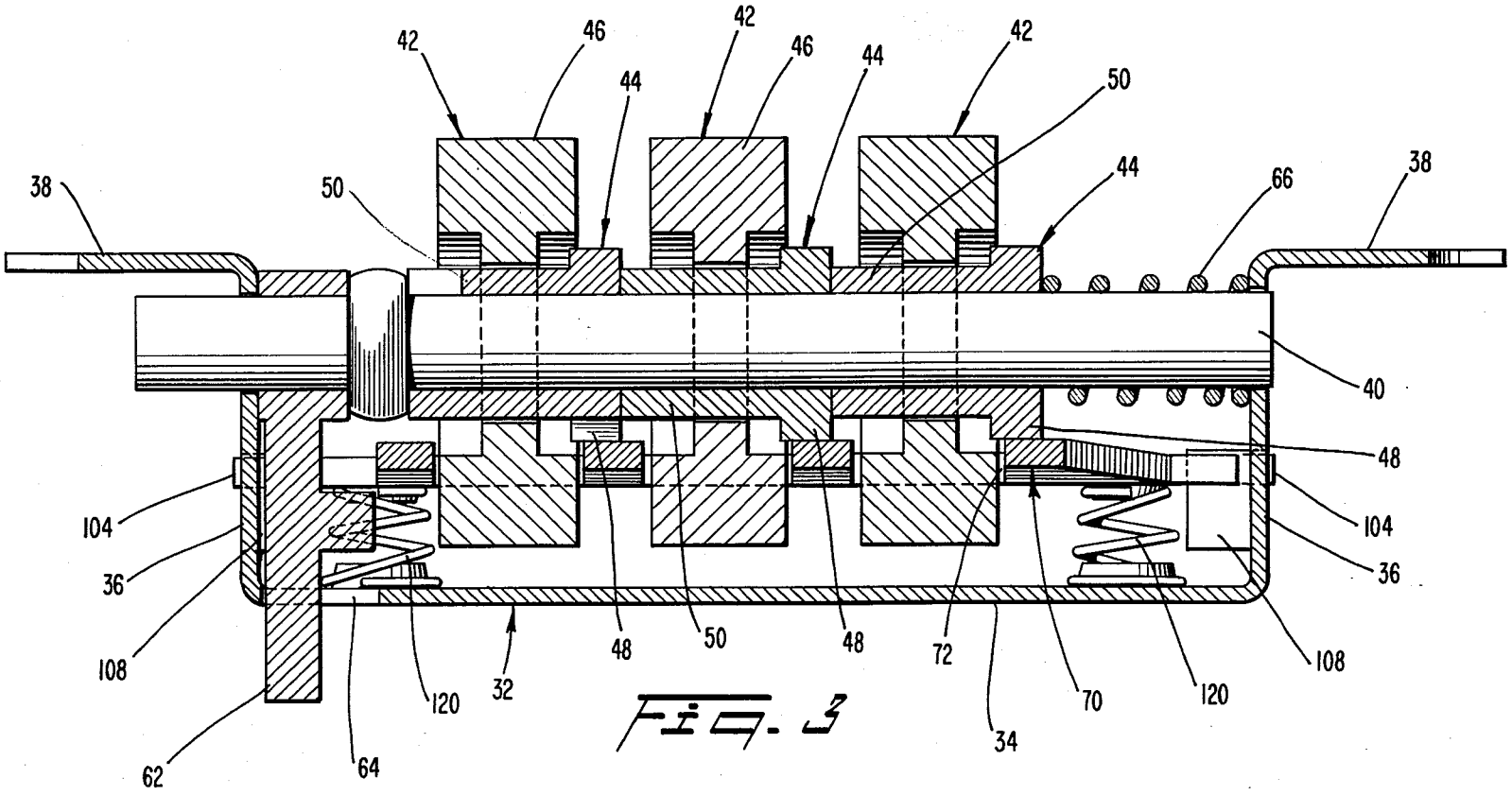
FIG. 3 is a longitudinal sectional view taken through the lock.

Mounted on the lid 14 is a lock unit 30 according to the present invention, which lock is of the permutation or combination type. The lock unit comprises a frame 32 which includes a base 34 and a pair of side walls 36 (FIG. 3) projecting perpendicularly from opposite ends of the base 34. The side walls 36 include mounting ears 38 which facilitate mounting of the frame to the lid.

A shaft 40 has its opposite ends mounted in aligned holes of the side walls 36 such that the shaft 40 is spaced from and oriented parallel to the base 34.

Mounted on the shaft is a conventional assembly of rotary members 42. The rotary members 42 each comprise a cam wheel 44 and a rotary dial 46. The cam wheel 44 is mounted for both rotary and axial movement and includes an actuating section 48 and a coaxial coupling section 50 formed integrally therewith. The periphery of the actuating section has an outer peripheral surface 51 which includes a cylindrical camming segment 52 extending over most of the periphery, and an indented segment 54 extending over the remainder of the periphery. The indented segment 54 is of smaller radius than the camming segment 52 and may be of flat or V-shaped configuration for example.

The coupling section 50 includes at least one longitudinally extending rib (FIG. 2) 56. The rotary dials 46 are each hollow and configured to telescopingly receive the coupling section 50 of an associated cam wheel 44 such that the rib 56 of the latter enters a corresponding groove in the dial to effect a rotary drive transmission therebetween. The dials have the standard indicia along a peripheral indicator surface thereof. The lock unit 30 is arranged so that the peripheral surfaces of the dials project through slots 58 of a face plate 60, the latter being affixed to the frame of the lid 14.

The dials 46 and the cam wheels 44 are relatively separable in an axial direction to disengage the drive coupling between the ribs 56 of the cam wheels 44 and the dials. This is achieved by mounting a handle 62 (FIG. 6) on the shaft, which handle projects through a slot 64 in the frame 32. By moving the handle 62, the shaft 40 and the cam wheels 44 are moved axially relative to the dials 46 to disengage the drive coupling. A coil compression spring 66 (FIG. 2) returns the cam wheels 44 to their original position when the handle 62 is released.

Disposed within the frame intermediate the base 34 and the shaft 40 is a bolt 70. The bolt is generally of plate-shaped construction and includes a series of slots 72 through which the dials 46 project, enabling the bolt 72 to engage the actuating surfaces 51 of the cam wheels 44. The bolt may have a flat surface in contact with such surfaces 51, or inverted V-shaped ridges 74 if the cam wheels have V-shaped grooves 54.

Figure 2:
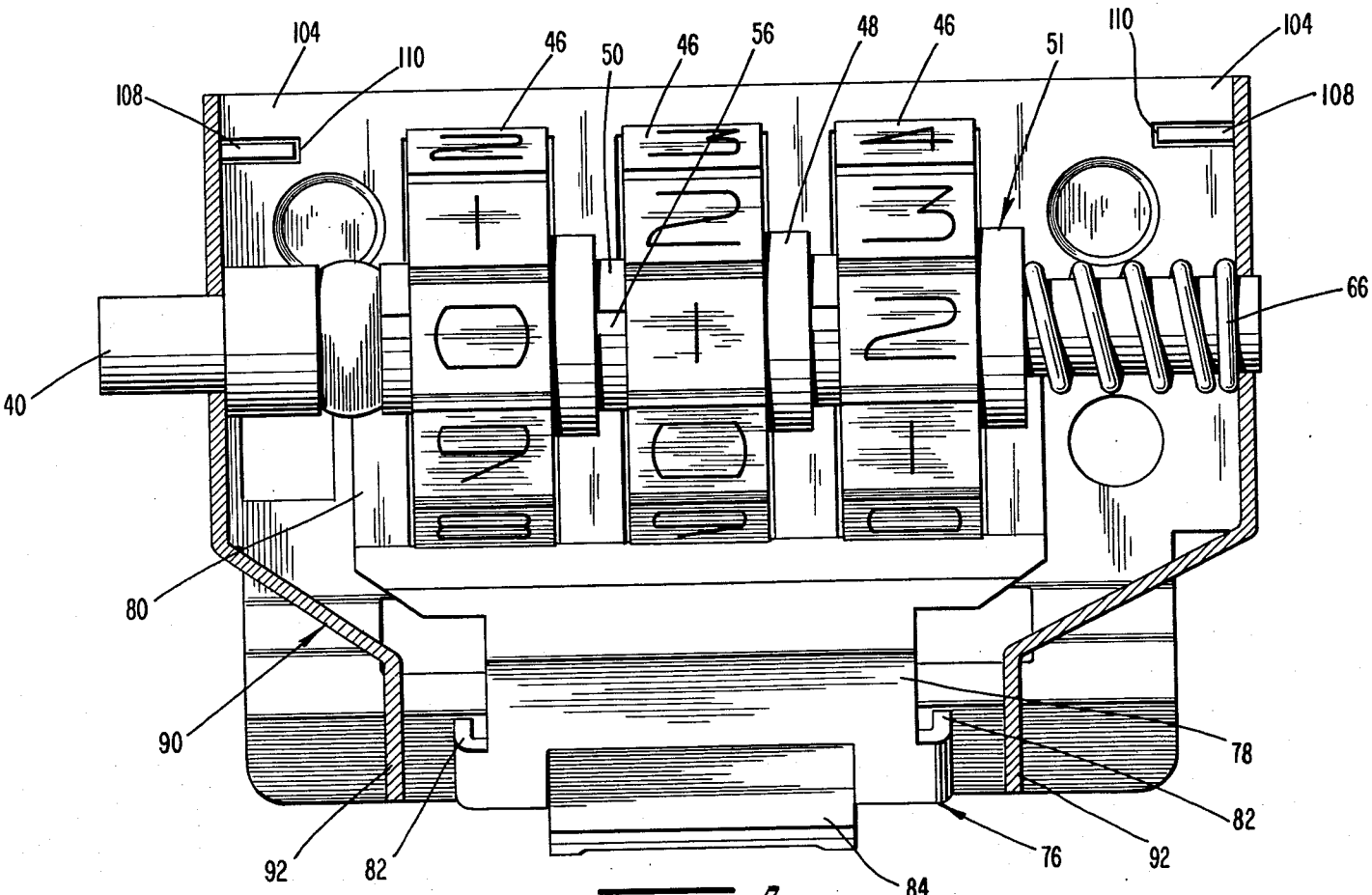
FIG. 2 is a plan view of the lock, with a portion of its mounting frame broken away.

The lock unit described thus far is of conventional configuration. In accordance with the present invention, the bolt 70 has a front end which includes a latch 76 for making locking contact with the hasp 20. The latch 76 includes a tongue 78 projecting forwardly from a larger-width body portion 80 of the bolt 70 (FIG. 2). The tongue 78 is angled forwardly toward the plane of the base 34 and carries a pair of hooks 82 at its forwardmost end. The hooks also project toward the plane of the base 34 and are spaced apart in a direction parallel to the shaft 40.

A flange 84 is disposed between the hooks 82 and includes a front face 85 which is inclined from the tongue 78 in a forward direction away from the plane of the base 34. Front edges 86 of the hooks are inclined generally rearwardly toward the plane of the base 34 and are generally aligned with the front face 85 of the flange 84 when viewed from the side (FIG. 1) to define therewith a deflecting surface 85, 86 as will be hereinafter explained.

A pair of guide fingers (FIG. 2) are angled forwardly and inwardly (convergingly) from the side walls of the frame and terminate in a pair of forwardly projecting parallel tabs 92. The guide arms 90 are spaced from the base 34 to define therewith a pair of guide slots 94 (FIG. 4) which are spaced apart in a direction parallel to the shaft 40. The guide slots 94 are sized to receive the hasp 20.

A portion 96 of the base 34 is bent perpendicularly toward the bolt 70. A plurality of leaf springs 98 extend through a slot in the bent-up portion 96 and are directed toward the dials 46. The free ends of the leaf springs 98 engage notches 100 in the dials to yieldably retain the dials in position.

A front edge 102 of the base 34 is flared in a direction away from the guide arms 90 to facilitate entry of the hasp 20 into the guide slots 94.

In accordance with the present invention, the rear end of the bolt 70 cooperates in a unique manner with the frame 32 permitting the bolt to receive the hasp regardless of whether the latch 76 is in a locked or unlocked position.

In one preferred arrangement, a rear end of the bolt 70 includes a pair of projections or lugs 104 (FIGS. 1, 2) projecting outwardly in directions parallel to the shaft 40. Each side wall 36 of the frame has a rearwardly facing rear edge 106 defined by an inwardly bent portion 108 (FIGS. 2, 3) of the side wall.

Another embodiment of the invention is depicted in FIGS. 6 and 7, wherein a rear portion 37A of the base 34A is bent toward the bolt 70A. A slot 150 is formed in the bent portion 37A, an upper edge 109A of which defines a stop shoulder. A rear end of the bolt 70A includes a projection 152 which is movable within a gide recess defined by the slots 150. Coil springs 120 bias the bolt 70A toward the shaft so that the projection 152 is urged against the stop surface 109A. Also located at the rear end of the bolt are lugs 104A which guide the movement of the bolt. It will be appreciated that the stop surface 109A forms the first fulcrum 121A about which the bolt swings when moving to and from a locked mode under the control of the camming wheels 44.

A second fulcrum 122 is provided in a manner identical to that of the eariler described embodiment. The bolt 70A swings between its locked and unlocked modes about such second fulcrum 122 under the control of the hasp 20. This movement of the bolt 70A is permitted since the projection 152 of the bolt is unsupported opposite the stop surface 109A. The bent portions 108 are aligned with a slot 110 in the bolt formed between the lugs 104 and the remainder of the bolt 70 (FIG. 2).

The shoulders 109 and rear edges 106 of the side walls 36 together define recesses within which the lugs 104 may travel in directions perpendicular to the base 34. That is, the lugs 104 are unsupported opposite the shoulders 109 so as to be movable away from those shoulders 109.

Figure 4:
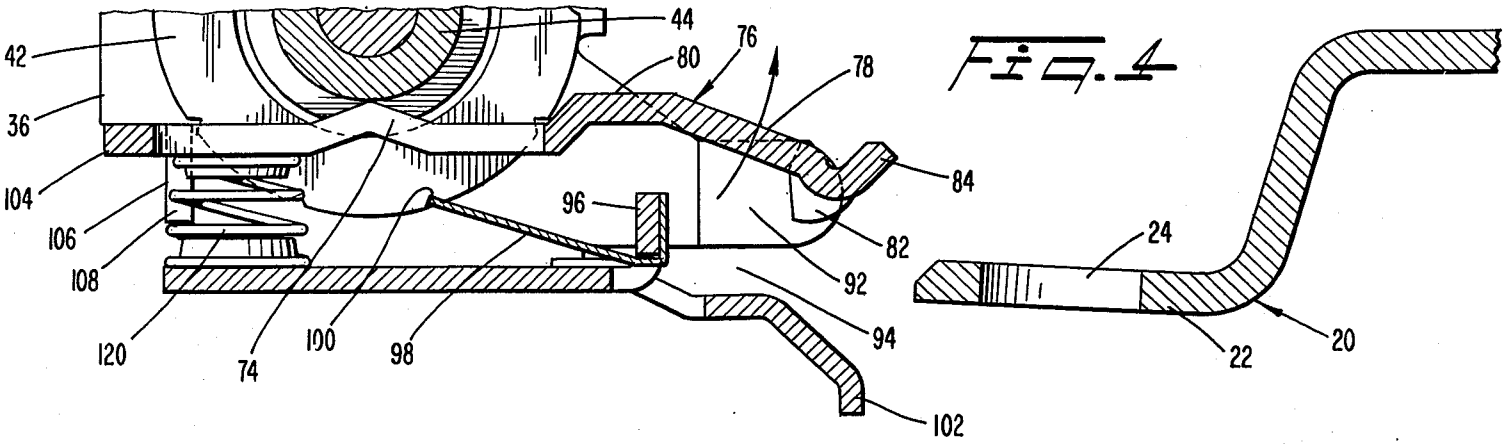
FIG. 4 is a cross-sectional view taken through the lock, depicting the bolt in an unlocked condition, with a hasp being moved toward or away from the lock.

Such movement opposite the shoulders 109 is opposed by a pair of yieldable coil compression springs 120 which are arranged to act between the base 34 and the bolt 70 at locations intermediate the lugs 104 and latch 76, but preferably closer to the lugs 104. The springs 120 bias the bolt 70 toward the cam wheels 44, and thus bias the lugs 104 against the shoulders 109. When the bolt is opposed by all of the indented segments 54 of the cam wheels 44, the latch 76 will be disposed in its unlocking position out of the common plane of the guide slots 94. The hasp 20 may thus be freely inserted or removed from the locking unit, as depicted in FIG. 4.

When any one or more of the cam wheels 44 is rotated to bring the camming segment(s) 52 (rather than the indented segment(s) 54) into opposing relation to the bolt, the latch 76 will be displaced to a locking position against the spring bias (FIG. 1). Such swinging movement will occur about a first fulcrum 121 defined by the interengagement between the lugs 104 and the shoulders 109. The latch 76 thus assumes a locking position (FIG. 1) in which the hooks 82 are disposed in a capture zone, e.g., within the common plane of the guide slots 94. Removal of the hasp 20 is prevented when the latch is so oriented.

Figure 5:
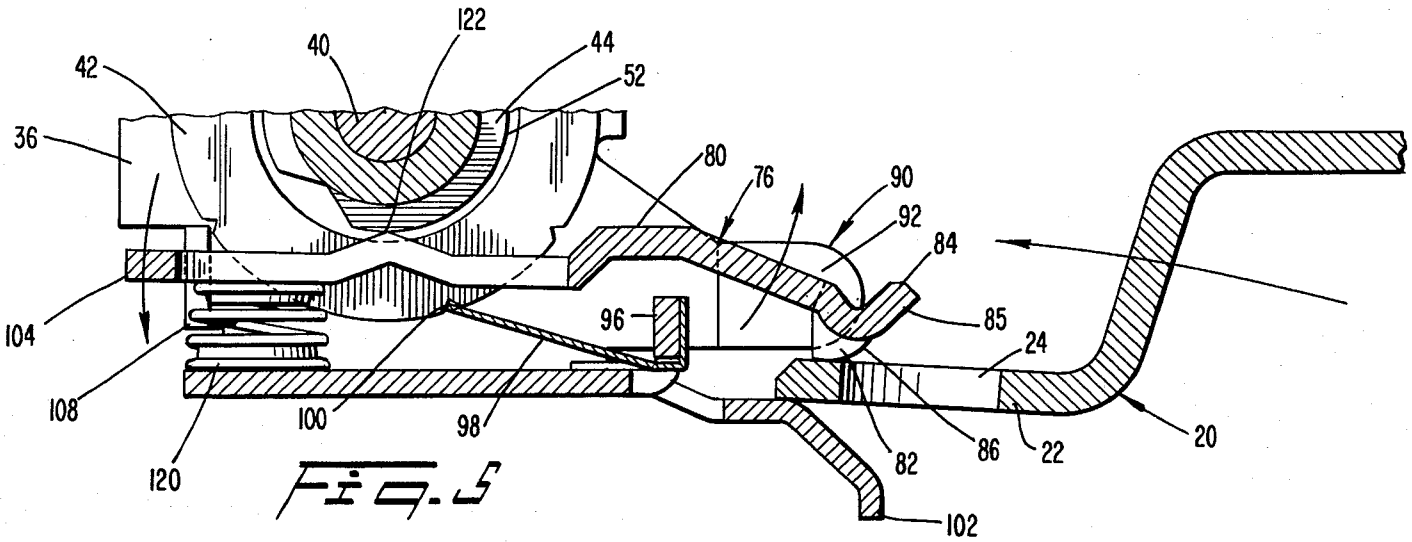
FIG. 5 is a view similar to FIG. 4, depicting the bolt as it is being cammed toward an unlocking position by the hasp as the latter is introduced into the lock.

In accordance with the present invention, the lock unit 30 is able to receive and lock to the hasp 20 even with the latch 76 in its locking position. That is, the hasp 20 is moved into the capture zone, the hasp 20 contacts the inclined deflecting surface 85, 86 (FIG. 5) and cams the latch end of the bolt 70 away from the capture zone against the bias of the yieldable springs 120. In so doing, the bolt 70 swings about a second fulcrum 122 defined by the interengagement between the bolt 70 and the camming segment(s) 52 of those cam wheel(s) 44 which are in a locking mode. Such swinging movement about the second fulcrum 122 is permitted since the lugs 104 are unsupported opposite the shoulders 109 and are free to move within the recesses located along the rear edges 106 of the side walls 36 of the frame 32.

Thus, when the bolt 70 swings about the second fulcrum 122, the latch 76 moves away from the plane of the base 34 toward its unlocking position, and the lugs 104 move away from the shoulders 109.

Once the hasp 20 has entered the lock unit 30 such that the hasp aperture 24 becomes aligned with the latch hooks 82, the coil springs 120 swing the bolt 70 so as to return the latch 76 to its locked position (FIG. 1).

When the latch is thereafter unlocked (FIG. 4), i.e., when all of the indented segments 54 are moved into opposing relation with the bolt 70, the bolt swings about the first fulcrum 121, so that the hooks 82 travel out of the capture zone.

IN OPERATION, the lock unit 30 is disposed in its unlocked condition when all of the cam wheels 44 have their indented portions 54 opposing the bolt (FIG. 4). That is, the coil springs 120 urge the bolt 70 away from the base 34 such that the latch hooks 82 are out of the capture zone. When it is desired to lock the lock unit 30, one or more of the dials 46 is rotated to thereby displace corresponding ones of the cam wheels 44 so that the camming segment(s) 52 swings the bolt 70 away from the shaft 40 about the first fulcrum 121. The latch 76 thus assumes a locking position wherein the hooks 82 are disposed in the capture zone (FIG. 1). If the hasp 20 is disposed within the capture zone, locking of the hasp will occur. If the hasp is not so disposed, locking can still be effected without reopening the bolt 70, by simply closing the container sections 12, 14 such that the hasp 20 contacts the deflecting surface 85, 86 (FIG. 5) and swings the bolt 70 about the second fulcrum 122. Accordingly, the latch 76 is cammed away from the capture zone against the spring bias, until the hooks 82 become aligned with the hasp aperture 24. At that point, the hooks 82 enter the aperture 24 under the bias of the springs 120.

The lock unit 30 can be unlocked by arranging all of the camming segments 52 in opposing relation to the bolt 70 so that the springs 120 swing the latch end of the bolt 70 about the first fulcrum 121.

It will be appreciated that the lock unit 30 according to the present invention conveniently enables a hasp to be fixed in a locked mode even when the lock unit itself is in a locked condition. This is achieved without presenting an appreciable security problem since the bolt must still be moved in the usual unlocking direction, i.e., toward the dials, in order to be opened. It would be very difficult to produce such a movement of the bolt by means of a tool inserted through the face plate, especially since the force required to unlock the latch about the second fulcrum is greater than that required for the customary unlocking movement about the first fulcrum, since the second fulcrum yields a shorter moment arm. Also, the lock unit does not have to be of additional height as would be needed if the latch were swung away from the dials (i.e., opposite the normal unlocking direction) when cammed open by the hasp.

Furthermore, the possible designs of the hasp and latch design are not limited as would be the case if provision had to be made for achieving a mating when the latch approaches the hasp from two different directions. Thus, the hasp can have a fully closed aperture, rather than employing hooks that can tend to become caught on clothing. This enables the hasp to be located on the box section of the luggage while presenting minimal risk of being caught on clothing.

The above advantages are achieved without requiring substantial changes in the traditional design of such permutation locks.

Although the present invention has been described in connection with a preferred embodiment thereof, it will be appreciated by those skilled in the art that additions, modifications, substitutions, and deletions, may be made, without departing from the spirit and scope of the invention as defined in the appended claims.

What is claimed is:

1. A permutation lock of the type which is to receive and lock to a hasp, said lock comprising:

frame means including stop means, a shaft mounted to said frame means and defining a longitudinal axis, a plurality of manually actuable rotary members mounted on said shaft for rotary movement about said longitudinal axis, each rotary member including:

an annular actuating surface having a camming segment and an indented segment, and an annular indicator surface carrying indicia and being in driving engagement with said actuating surface, a bolt spaced from said shaft and including slot means through which said indicator surfaces project such that said actuating surfaces are engageable with said bolt, said bolt including front and rear ends, said rear end being disposed at said stop means and such that said stop means being situated on the same side of said bolt as said longitudinal axis, said front end having a deflecting surface and a latch disposable in a locking position when said bolt is engaged by an opposing one of said camming segments, and in an unlocking position when said bolt is opposed by all of said indented segments, spring means for biasing said bolt toward said actuating surfaces of said rotary members and biasing said rear end of said bolt against said stop means of said frame means, said spring means being yieldable to enable said camming segments to swing said bolt about a first fulcrum at said stop means to move said latch from said unlocking position to said locking position, said rear end of said bolt means being unsupported opposite said stop means so as to be movable in a direction away from said stop means in response to swinging of said bolt about a second fulcrum defined by at least one of said camming segments to enable said latch to be moved toward said unlocking position from said locking position when so urged by said hasp acting against said deflecting surface.

2. A lock according to claim 1, wherein said frame means includes a base and a pair of side walls projecting generally perpendicularly from said base, said shaft having its ends mounted to said side walls and being spaced from and parallel to said base.

3. A lock according to claim 2, wherein said side walls each include a rear edge extending perpendicularly from said base to said stop means, the latter comprising a pair of rearwardly projecting edges extending parallel to said base and forming recesses together with said rear edges of said side walls, said rear end of said bolt including a pair of lugs projecting outwardly parallel to said longitudinal axis and into said recesses.

4. A lock according to claim 2, wherein said spring means comprising coil compression springs disposed between said bolt and said base intermediate said front and rear ends of said bolt.

5. A lock according to claim 2, wherein said latch comprises at least one hook projecting toward the plane of said base.

6. A lock according to claim 5, wherein said at least one hook comprises a pair of said hooks spaced apart in a direction parallel to said shaft, said deflecting surface including front edges of said hooks and inclined in a direction forwardly and away from said base.

7. A permutation lock of the type which is to receive and lock to a hasp, said lock comprising:

a frame having a base and a pair of side walls projecting from opposite ends of said base, said frame having front and rear sides and including a rear stop surface, a shaft having opposite ends mounted to said side walls, said shaft being spaced from said base and extending parallel thereto and parallel to said stop surface to define a longitudinal axis, a plurality of manually rotatable members mounted on said shaft for rotation about said longitudinal axis, each rotary member including:

an annular actuating surface having a camming segment and an indented segment, and an annular indicator surface carrying indicia and being in driving engagement with said actuating surface, means for selectively moving said indicator surface out of said driving engagement with said actuating surface to enable the former to be rotated relative to the latter for changing the lock permutation, a bolt spaced from said shaft and including a plurality of slots through which said indicator surfaces project such that said actuating surfaces are engageable with said bolt, said bolt including:

a front end disposed at said front side of said frame means and having a deflecting surface and a latch disposable in a locking position when said bolt is engaged by an opposing one of said camming segments, and in an unlocking position when said bolt is opposed by all of said indented segments, and a rear end disposed at said rear side of said frame means, said rear end including at least one projection extending parallel to said stop surface, said stop surface being situated on the same side of said bolt as said longitudinal axis, spring means acting between said frame means and said bolt for biasing said bolt toward said actuating surfaces of said rotary members and biasing said projection toward said stop surface, said spring means being yieldable to enable said camming segments to swing said bolt about a first fulcrum defined by said stop surface to move said latch from said unlocking position to said locking position, said projection being movable in a direction away from said stop surface in response to swinging of said bolt about a second fulcrum defined by at least one of said camming segments, to enable said latch to be moved away from said base to said unlocking position when so urged by said hasp acting upon said deflecting surface.

8. A lock according to claim 7, wherein said spring means comprises coil compression springs disposed between said bolt and said base intermediate said front and rear ends of said bolt.

9. A lock according to claim 7, wherein said latch comprises at least one hook projecting toward the plane of said base.

10. A latch assembly according to claim 9, wherein said at least one hook comprises a pair of said hooks spaced apart in a direction parallel to said shaft, said deflecting surface including front edges of said hooks and inclined in a direction forwardly and away from said base.

11. A container comprising a box section and a lid section hinged thereto, one of said sections having a hasp and the other having a lock of the permutation type, said hasp having a fully enclosed aperture, said lock comprising:

a frame having a base portion and a pair of side wall portions projecting from opposite ends of said base portion, said frame including a stop shoulder, a shaft having opposite ends mounted in said side wall portions, said shaft being spaced from and extending parallel to the plane of said base portion, a plurality of cam wheels mounted on said shaft for rotation about a longitudinal axis, said cam wheels each including an actuating section and a coupling section extending axially therefrom, the actuating section having an outer periphery including a camming segment and an indented segment of lesser radius, a plurality of manually rotatable dials respectively mounted on said coupling sections in driving engagement therewith, said dials each having an outer periphery of larger diameter than that of said actuating section and containing indicia, manually engageable means for moving said cam wheels axially relative to said dials against a spring bias to drivingly disengage said coupling sections from said dials to permit the permutation to be changed, a bolt disposed intermediate said shaft and said base portion and including a plurality of slots through which said dials project, such that said outer peripheries of said actuating sections are engageable with said bolt, said bolt including:

a front end having a deflecting surface and at least one hook extending toward the plane of said base portion, said hook being disposable in a locking position when said bolt is engaged by an opposing one of said camming segments, and in an unlocking position when said bolt is opposed by all of said indented segments, and a rear end disposed at an opposite side of said shaft from said latch and including a projection, said stop shoulder being situated on the same side of said bolt as said longitudinal axis, spring means acting between said base portion and said bolt intermediate said front and rear ends of the latter for biasing said bolt toward said actuating sections and biasing said projection toward said stop shoulder, said spring means being yieldable to enable said camming segments to swing said bolt about a first fulcrum defined by said stop shoulder and move said hook from said unlocking position to said locking position, said projection being unsupported opposite said stop shoulder so as to be movable in a direction away from said shoulder in response to swinging of said bolt about a second fulcrum defined by at least one of said camming segments to enable said hook to be moved to said unlocking position from said locking position when so urged by the hasp acting against said deflecting surface.

12. A lock according to claim 11, wherein said at least one hook comprises two hooks projecting toward the plane of said base.

13. A lock according to claim 12, wherein said deflecting surface includes front edges of said hooks and being inclined in a direction forwardly and away from said base.

14. A lock according to claim 11, wherein said hasp is mounted on said box section.

15. A permutation lock of the type which is to receive and lock to a hasp, said lock comprising:

frame means including stop means, a shaft mounted to said frame means and defining a longitudinal axis, a plurality of manually actuable rotary members mounted on said shaft for rotary movement about said longitudinal axis, each rotary member including:

an annular actuating surface having a camming segment and an indented segment, and an annular indicator surface carrying indicia and being in driving engagement with said actuating surface, a bolt spaced from said shaft and including slot means through which said indicator surfaces project such that said actuating surfaces are engageable with said bolt, said bolt including front and rear ends, said front end having a deflecting surface and a latch disposable in a locking position when said bolt is engaged by an opposing one of said camming segments, and in an unlocking position when said bolt is opposed by all of said indented segments, spring means for biasing said bolt toward said actuating surfaces of said rotary members and biasing said rear end of said bolt against said stop means of said frame means, said spring means being yieldable to enable said camming segments to swing said bolt about a first fulcrum at said stop means to move said latch from said unlocking position to said locking position, said stop means being located so as to engage said rear end of said bolt while said spring means engages said bolt forwardly of said stop means, said rear end of said bolt means being unsupported opposite said stop means so as to be movable in a direction away from said stop means in response to swinging of said bolt about a second fulcrum defined by at least one of said camming segments to enable said latch to be moved toward said unlocking position from said locking position when so surged by said hasp acting against said deflecting surface.

* * * * *